United States Patent [19]

Forbes

[11] Patent Number: 4,923,083

[45] Date of Patent: May 8, 1990

[54] STRAW FOR STORAGE WITHIN BEVERAGE CONTAINER

[76] Inventor: Raymond Forbes, 204 Glenburn Dr., Pittsburgh, Pa. 15236

[21] Appl. No.: 279,833

[22] Filed: Dec. 5, 1988

Related U.S. Application Data

[62] Division of Ser. No. 92,164, Sep. 2, 1987.

[51] Int. Cl.[5] ..... B65D 47/06

[52] U.S. Cl. ..... 220/90.2; 220/270; 229/7 S; 215/1 A

[58] Field of Search ..... 220/90.2, 170; 229/75; 212/1 A

[56] References Cited

U.S. PATENT DOCUMENTS

| | | |
|---|---|---|
| 3,946,895 | 3/1976 | Pugh . |
| 4,078,692 | 3/1978 | Stein . |
| 4,109,817 | 8/1978 | Payne et al. . |
| 4,226,356 | 10/1980 | Lemelson . |
| 4,228,913 | 10/1980 | Jack et al. . |
| 4,305,521 | 12/1981 | Komatsuta et al. . |
| 4,356,927 | 11/1982 | Cooper et al. . |
| 4,462,503 | 7/1984 | DiRaffaele et al. . |
| 4,537,324 | 8/1985 | Wang . |
| 4,582,213 | 4/1986 | Park et al. . |

*Primary Examiner*—Joseph M. Moy

*Attorney, Agent, or Firm*—Buchanan Ingersoll

[57] ABSTRACT

A beverage container having a metallic lid with a bend down panel on the lid to define an opening for the lid. A rupturable score line separates the panel from the lid and facilitates detachment of the panel from the lid and bending of the panel downwardly to provide the opening while a portion of the panel remains hingedly attached to the lid. A non-detachable pull tab is secured to the top of the lid for applying a manual force for rupturing the score line and bending the lid downwardly. A rotatable straw delivery mechanism holding a straw is secured to the underside of the lid. The straw delivery mechanism is positioned to permit the panel to bend downwardly to provide straw-free drinking access through the opening when the panel is depressed to a first position. When the panel is then depressed further to a second position, the panel comes into contact with a contact elbow on the straw delivery mechanism. This contact rotates the straw delivery mechanism to provide a pop-up straw through the opening. The invention also relates to a bent and curved corrugated straw which is compressed so that it bears upon the interior surface of the container at a multiplicity of positions in the container to provide a spring-like quality which induces the pop-up characteristic.

8 Claims, 5 Drawing Sheets

STRAW FOR STORAGE WITHIN BEVERAGE CONTAINER

This application is a division of application Ser. No. 092,164, filed Sept. 2, 1987.

This invention relates to a container for a beverage, such as carbonated soft drinks, fruit juices, etc., wherein the container has a pull tab for depressing a lid panel to provide an opening for the container.

More particularly, this invention relates to a beverage container having a pop-up straw entirely enclosed within the container.

Still more particularly, this invention relates to a beverage container having an interior automatic straw delivery mechanism for delivering a pop-up straw through the container opening. The container can be opened by depressing the lid panel to a first position, permitting to the consumer straw-free drinking of the liquid content directly from the container by tilting the container at the consumer's mouth. The container can be opened further by depressing the lid panel an additional amount to a second position at which the straw delivery mechanism is actuated and a pop-up straw appears at the opening so that the consumer can drink the liquid content through the straw.

This invention also relates to a pop-up straw for pre-pop-up storage entirely within the beverage container. The pop-up straw can be provided with corrugations. The straw can be straight but is preferably bent and/or curved to impart stability to the straw during transport and to provide a spring-like quality to the straw to induce the pop-up characteristic. If the straw is bent, it can be bent into a zigzag pattern.

The beverage container of this invention has a metallic lid with a bend down panel on the lid to define an opening for the lid. A rupturable score line is impressed to separate the panel from the lid and to facilitate detachment of the panel from the lid to provide the opening upon bending the panel while a portion of the panel remains hingedly attached to the lid. A non-detachable pull tab is secured to the top of the lid for applying a force for rupturing the score line and bending the lid downwardly.

A straw is retained entirely within the closed container and is held within the container by a rotatable straw holding and delivery mechanism. The mechanism can be rotatably secured to the underside of the lid by means of a rivet whose head is on the underside of the lid. The straw delivery mechanism is positioned laterally with respect to the panel to permit the panel to bend downwardly to provide drinking access through said opening. The panel comes into contact with a projecting elbow in the straw delivery mechanism during bending. This contact rotates the straw delivery mechanism to the opening to provide a pop-up straw through the opening.

The straw delivery mechanism is secured to the underside of the lid at a position to permit downward bending of the panel to a first position to provide optional straw-free drinking access through said opening. The mechanism is positioned so that downward bending beyond the straw-free access position to a second position brings the panel into contact with the mechanism causing rotation of the mechanism to deliver a straw to the opening.

The straw delivery mechanism is out of contact with the panel and clear of the opening as the panel initially bends downwardly from the closed position to provide the straw-free drinking access through the opening by tilting the container directly at a consumer's mouth. In this panel position drinking occurs without interference of the straw or of the straw delivery mechanism. The panel subsequently comes into contact with the straw delivery mechanism as the panel bends further to the contact position. The contact moves the straw delivery mechanism to the opening in the lid to provide a pop-up straw through the opening.

The straw delivery mechanism can take many forms. For example, the straw delivery mechanism can comprise a U-shaped or arc-shaped arm with the arm rotatably secured at an intermediate position thereof to the underside of the lid. One end of the arm can be provided with a downwardly projecting elbow, with the elbow being positioned for contacting the bottom of the panel for rotating the arm. The other end of the arm is provided with a receptable for holding the straw. It is this receptacle which is rotated to the opening.

In another embodiment, the straw delivery mechanism can comprise a U-shaped or arc-shaped arm, with the arm slideably and rotatably secured at one end thereof to the underside of the lid. The other end of the arm is provided with a receptacle for holding a straw to be rotated to the opening. The end secured to the underside of the lid has a downwardly projecting elbow positioned to be contacted by the underside of the panel. The arm can be secured to the panel by means of a rivet whose head is on the underside of the lid. The arm can first slide along the rivet and then rotate about the rivet. Guide elements are provided on the underside of the lid to guide the arm as it slides and rotates. The exterior edge of the arm can comprise a cam whose movement along one of the guide elements induces rotation.

If desired, the straw can be corrugated in an accordian-like manner at one or more positions, including the bottom of the straw and intermediate straw positions. The corrugations facilitate bending and curving of the straw to provide stability to the straw during transport and to provide springiness to the straw to induce the pop-up characteristic.

It is not essential that the straw be corrugated. By employing a suitable material, a straw can be provided which can be conveniently bent and curved without corrugations. Also, a straight straw can be employed.

In an advantageous embodiment, the straw can have a vertical straight top section and at least two bends below the top section with a downwardly inclined straight section descending from each bend. Sequential inclined sections incline downwardly in generally diametrically opposite directions so that the straw can bear upon the cylindrical wall of the container at diametrically opposite sides of the wall.

In another embodiment, the straw can have a vertical straight top section and at least one bend below the top section with a straight inclined section descending from each bend so that the straw can bear upon the cylindrical wall of the container. The bottom section of the straw can be curved with the curved section bearing upon the junction of the cylindrical wall and the bottom of the container.

In a particular embodiment, the straw can comprise a vertical straight top section and three bends below said top section. A first straight downwardly inclined section descends from the first bend to a second bend. The second bend is adapted to bear upon the cylindrical wall of the container at a first position thereon. A second straight downwardly inclined section descends from the second bend to a third bend. The third bend is adapted to bear on the cylindrical wall of a container at a second position thereon. Said first and said second positions can be in diametrically opposite sides of the cylindrical wall. This results in a zigzag straw configuration. The third bend leads to a curved bottom section of the straw. The curved bottom section is adapted to bear on the curved junction of the cylindrical wall and the bottom of the container.

This invention also relates to a method for the manufacturing assembly of a cylindrical beverage container having a lid wherein the lid has a pull tab and a bend down panel for providing an opening on the lid and wherein the underside of the lid has an attached straw delivery mechanism. This method comprises inserting a bent and curved straw into the delivery mechanism and then inserting the lid with the inserted straw into the container so that the straw bears upon the interior surface of the container at multiple positions on the wall and bottom thereof. Then, the lid is sealed to the container whereby the straw is compressed in the container so that the straw will pop up upon pulling the pull tab and bending down the panel.

This invention also relates to a method of using a beverage container whose lid has a pull tab and a bend down panel for providing an opening on the lid wherein the underside of the lid has an attached straw delivery mechanism holding a pop-up straw for delivery through the opening. The method comprises pulling the pull tab to bend the panel downwardly to a first position without actuating the straw delivery mechanism. The first position provides an opening in the lid for drinking liquid from the container without the straw. Then, the pull tab is additionally pulled to bend the panel downwardly further to a second position. The additional pulling step actuates the straw delivery mechanism to pop up the straw through the opening.

This invention will be more completely understood by reference to the attached drawings in which.

Figure 1:
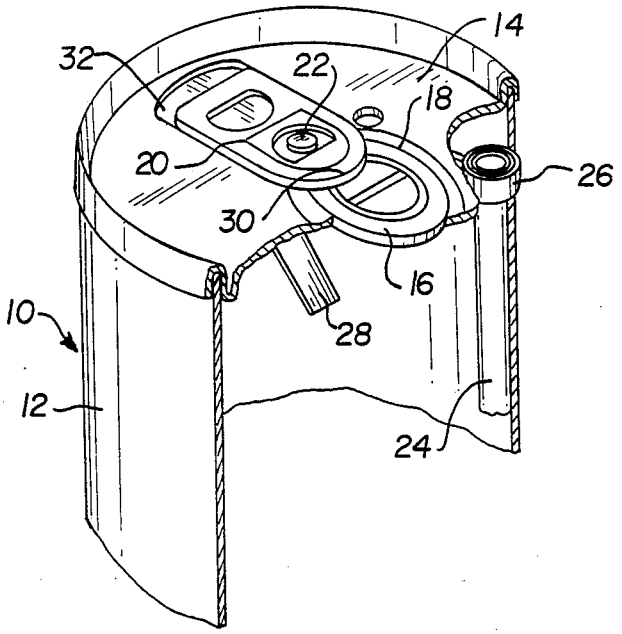
FIG. 1 is a cutaway view of a beverage container of the invention with closed lid.

FIG. 1 shows beverage container 10 having cylindrical wall 12 and top lid 14. Lid 14 is closed by panel 16 which is demarked from lid 14 by weakened and rupturable score line 18. Non-detachable pull tab 20 is attached to lid 14 by means of rivet 22. A straw delivery mechanism disposed for holding and moving straw 24 is disposed within container 10 on the underside of lid 14. The mechanism is more clearly shown in FIGS. 5, 6 and 7 but is mostly obstructed from view in FIG. 1. However, FIG. 1 shows cylindrical straw holding receptacle 26 and downwardly projecting elbow 28 of the mechanism.

Figure 2:
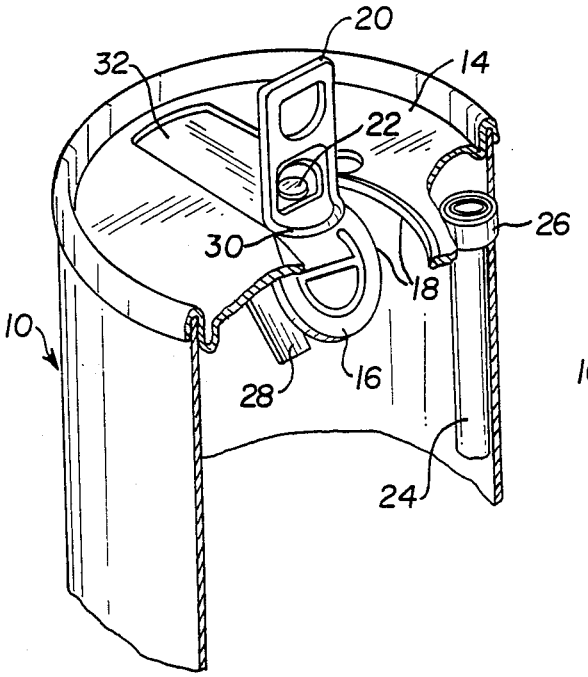
FIG. 2 is a cutaway view of the beverage container of FIG. 1 with the lid open to a drinking position.

FIG. 2 shows pull tab 20 in a manually lifted position at approximately 90 degrees. As stated, tab 20 is secured to lid 14 by rivet 22 and upon lifting of tab 20 its front end 30 is pushed downwardly so that it abuts against the top side of panel 16 to detach panel 16 from lid 14 at score line 18 and bend panel 16 downwardly into container 10. FIG. 2 shows panel 16 depressed to a first position at which lid 14 is open to provide drinking access of the lips and mouth of a consumer to the liquid contents of container 10 upon tilting of the container 10. However, at the position of panel 16 shown in FIG. 2 the underside of panel 16 has not yet contacted elbow 28 of the straw delivery mechanism, so that straw 24 remains in its normal or retracted position laterally removed from the opening of lid 14.

Figure 3:
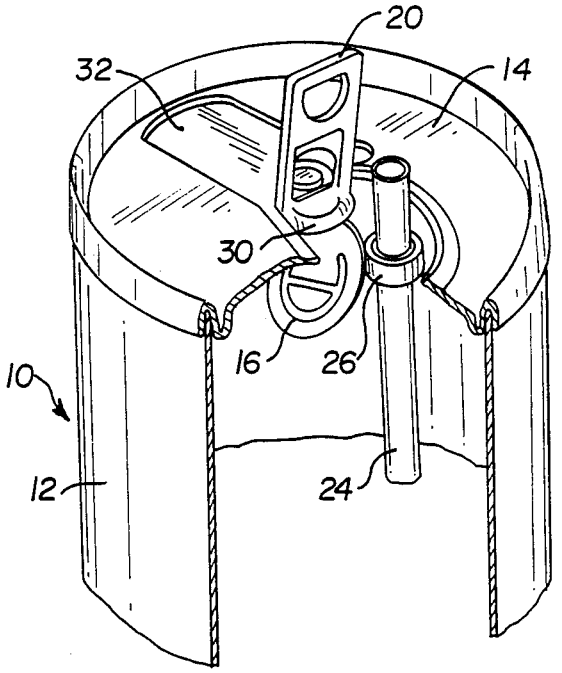
FIG. 3 is a cutaway view of the beverage container of FIG. 1 with open lid and pop-up straw.

FIG. 3 shows pull tab 20 manually pulled still further at approximately 90 degrees so that front end 30 of tab 20 further depresses panel 16. In the position of panel 16 shown in FIG. 3, the underside of panel 16 contacts elbow 28, which is hidden from view in FIG. 3, so that straw holding receptacle 26 is rotated laterally on a horizontal plane towards the opening in lid 14, allowing straw 24 to resiliently spring upwardly through the opening.

Figure 4:
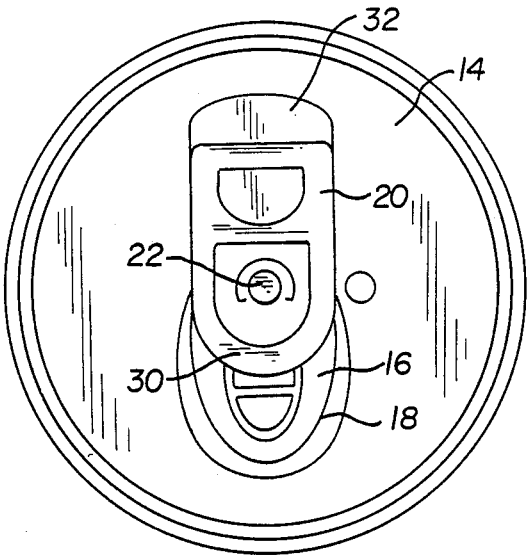
FIG. 4 is a top view of a closed lid.
Figure 5:
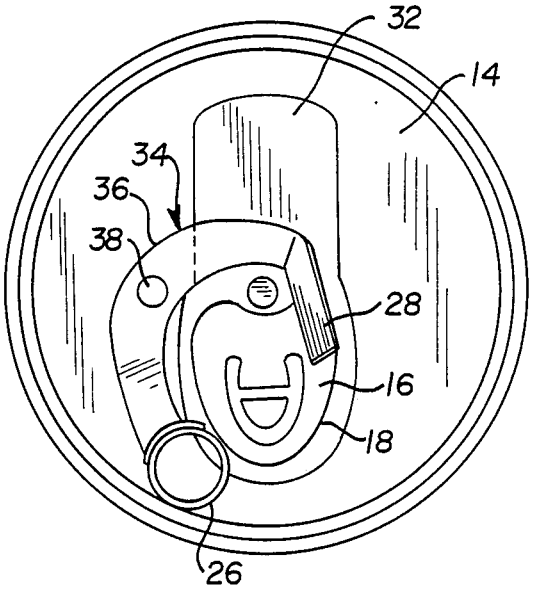
FIG. 5 is a bottom view of a closed lid with a straw delivery mechanism.

FIGS. 4 and 5 are top and bottom views, respectively, of lid 14 showing the lid in its normal or closed position and the straw holding mechanism in its normal or retracted position. As shown in FIG. 4, pull tab 20 rests horizontally in depression 32 in lid 14 and panel 16 is joined continuously with lid 14 and score line 18 is not yet severed. FIG. 5 shows straw delivery mechanism 34 comprising U-shaped or arc-shaped arm 36 rotatably secured to the underside of lid 14 by rivet 38. One end of arm 36 comprises downwardly depressed elbow 28 and the other end comprises cylindrical straw holding receptacle 26. As shown in FIG. 5, when panel 16 is in its closed position and score line 18 is not yet severed, straw receptacle 26 is laterally disposed with respect to panel 16 and bent elbow 28 is out of contact with the underside of panel 16.

Figure 6:
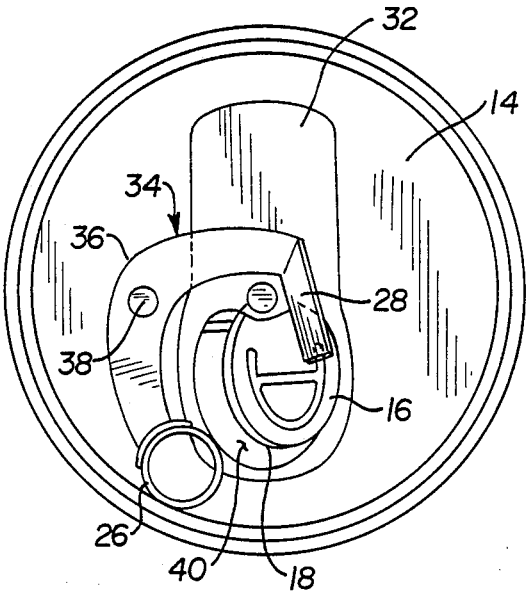
FIG. 6 is a bottom view of the lid of FIG. 5 open to a drinking position without pop-up straw.

FIG. 6 shows panel 16 downwardly bent to a first position to provide opening 40 in lid 14. Opening 40 is adequate to provide drinking access by a beverage consumer by applying the mouth and lips directly to the edge of lid 14 when the container is tilted without using a straw. At the first lid opening position shown in FIG. 6, the underside of lid 16 has not yet come into contact with elbow 28 of straw delivery mechanism 34. Thereby, there is no rotation of mechanism 34 and straw receptacle 26 remains under lid 14 and laterally disposed with respect to opening 40.

Figure 7:
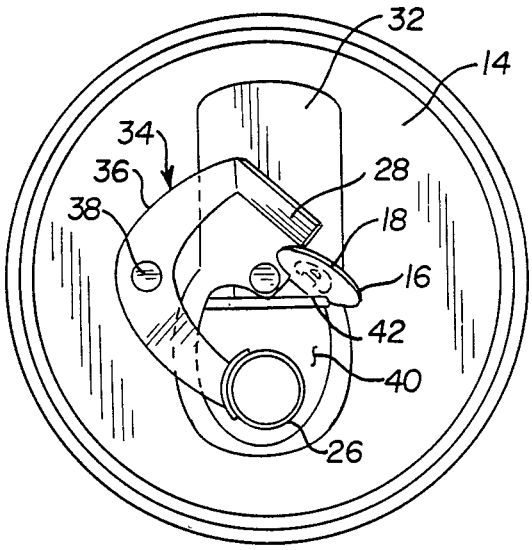
FIG. 7 is a bottom view of the lid of FIG. 5 open to a drinking position with straw in pop-up position.

FIG. 7 shows panel 16 depressed further to a second position. Panel 16 remains hingedly connected to lid 14 at edge 42 and is bent downwardly and to a side to the second position shown in FIG. 7, so that panel 16 pushes against elbow 28. The resulting movement of elbow 28 causes arm 36 to rotate on rivet 38 to rotate straw holding receptacle 26 underneath opening 40 to supply a resilient pop-up straw to opening 40.

Figure 8:
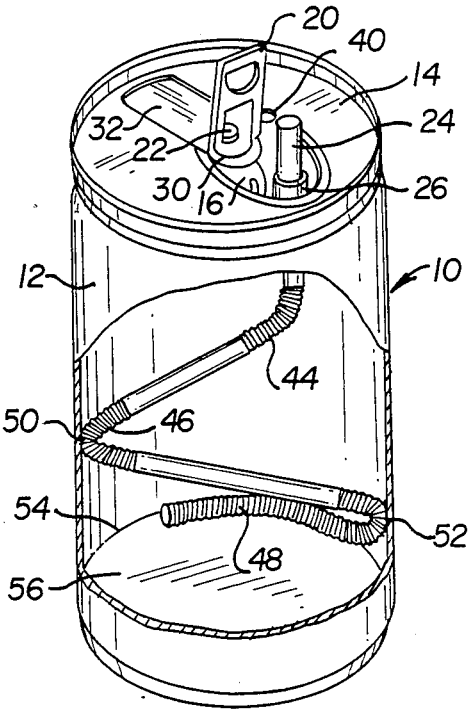
FIG. 8 is a cutaway view of a container with straw.

FIG. 8 shows straw 24 in its pop-up position with the end of straw 24 projecting upwardly through opening 40 and above lid 14. FIG. 8 shows that straw 24 is provided with a plurality of accordian-like corrugated regions 44, 46 and 48. The corrugations provide flexibility and a spring like quality to straw 24. The corrugations also allow the straw to bear upon the interior surfaces of container 10 at a plurality of diametrically opposing locations in order to provide stability to straw 24 during transport of container 10. For example, the bending of the straw at corrugations 46 allows the straw to bear upon the interior wall of cylinder 12 at position 50 and the bending of straw at corrugations 48 allows the straw to also bear upon a diametrically opposite position 52 of the interior wall of cylinder 12. Support of the straw at diametrically opposite bearing points 50 and 52, respectively, provides stability to the straw.

Additional stability is imparted to the straw by coiling or curving the corrugations at the bottom end of the straw along circular seam 54 formed between container bottom 56 and cylindrical wall 12. The curving of corrugated region 48 along seam 54 can extend along some or all of the circumference of seam 54.

Figure 10:
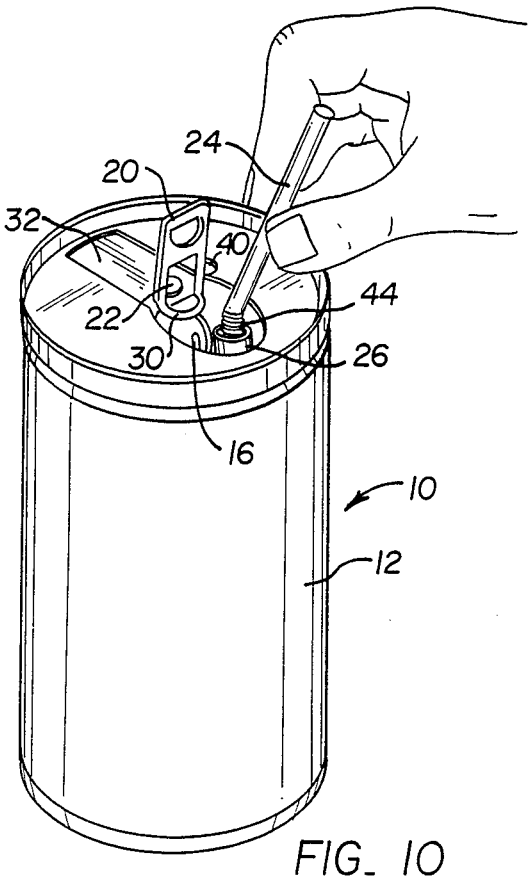
FIG. 10 illustrates manual bending of a pop-up straw during use.

The bearing of bent corrugated regions of the straw at opposing positions 50 and 52 of the interior wall of cylinder 12 and the curving of a corrugated bottom region of the straw along circular bottom seam 54 provides not only stability to the straw so that the straw tends to maintain a constant position and is relatively free of movement during transport of the container but also provides a spring-like or resilient characteristic to the straw. This spring-like quality causes the straw to pop-up when receptacle 26 is rotated to opening 40, as shown in FIG. 8, at which position straw 24 is no longer restrained by the underside of lid 14. After pop-up of the straw, the straw can be manually grasped and manually pulled up further, as shown in FIG. 10, until corrugated region 44 extends at least partially above receptacle 26, allowing straw 24 to be manually bent towards the drinker.

Figure 9:
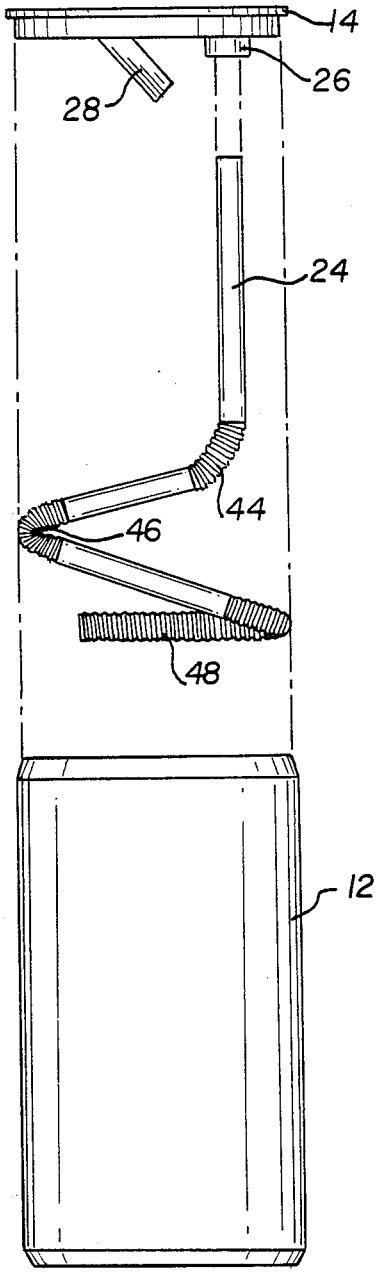
FIG. 9 is an exploded view to illustrate the assembly of a lid with straw into a beverage container.
Figure 14:
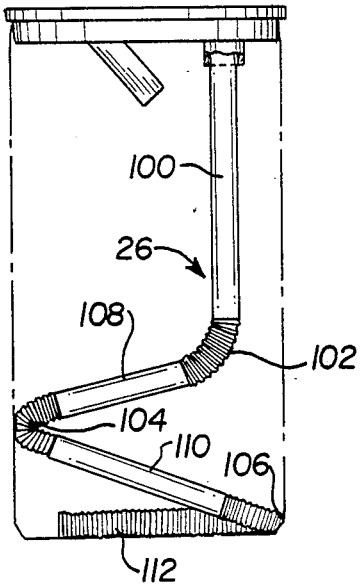
FIGS. 12, 13 and 14 illustrate various straws within a beverage container.

FIG. 9 is an exploded view of the container assembly to illustrate a preferred method of manufacture of the container assembly. The container assembly initially comprises three sub-assembly elements, including lid 14, straw 24 and container 12. Straw 24 is perfabricated with corrugated regions 44 and 46 corrugated region 48 which is bent and curved to conform with the in-container straw positioning shown in FIG. 8. Straw 24 is inserted into receptacle 26 and the combination lid-straw subassembly can be lowered into cylinder 12 which is pre-filled with beverage, followed by welding or otherwise sealing of lid 14 onto cylinder 12. Straw 24 is somewhat compressed within cylinder 24, as shown in FIG. 14, by virtue of the straw material and the accordian-like nature of the corrugations to provide a spring-like or resilient quality to the straw to accomplish the straw pop-up characteristic illustrated in FIG. 8. The straw material can comprise plastic, paper or plastic-coated paper.

Figure 11:
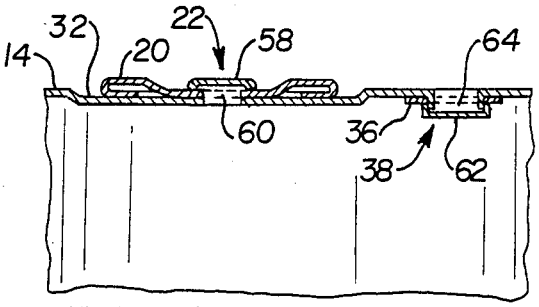
FIG. 11 is a cross-sectional view of a lid fragment illustrating rivets on the upper and lower lid surfaces.

FIG. 11 presents a cross-section detail of lid 14, showing that lid 14 is provided with two similar but oppositely positioned rivets including one rivet having its head at the upper surface of lid 14 and one rivet having its head at the lower surface of lid 14. Rivet 22 is used to capture pull tab 20 and has head 58 on the upper surface of lid 14 and well 60 along the lower surface of lid 14. Rivet 38 is used to rotatably capture arm 36 of straw rotation mechanism 34 and has head 62 on the lower surface of lid 14 and well 64 on the upper surface of lid 14.

Figure 12:
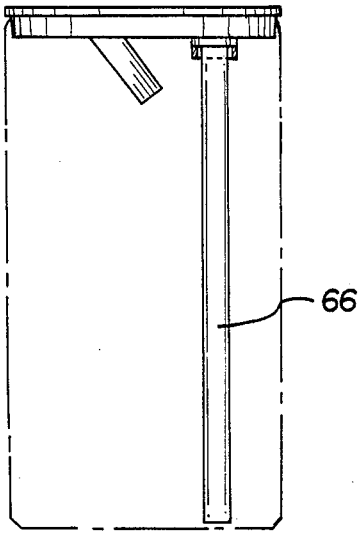
Figure 13:
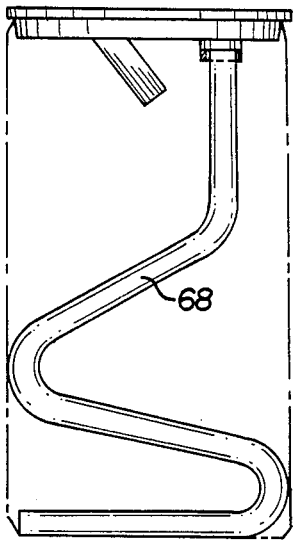

FIGS. 12 and 13 illustrate other straws that can be employed with the straw delivery mechanism of the invention. FIG. 12 shows straw 66 which is straight and unbent over its entire extent. The buoyancy of the beverage fluid is employed to pop straw 66 upwardly. FIG. 13 shows a straw which is preformed with a resiliently bent and curved configuration, but without corrugations. It is noted that the straws of FIGS. 13 and 14 are ecology straws in that their bent and curved configurations make it difficult to remove these straws entirely from the container and makes it nearly impossible for these straws to be accidentially separated from the beverage container after use.

Figure 15:
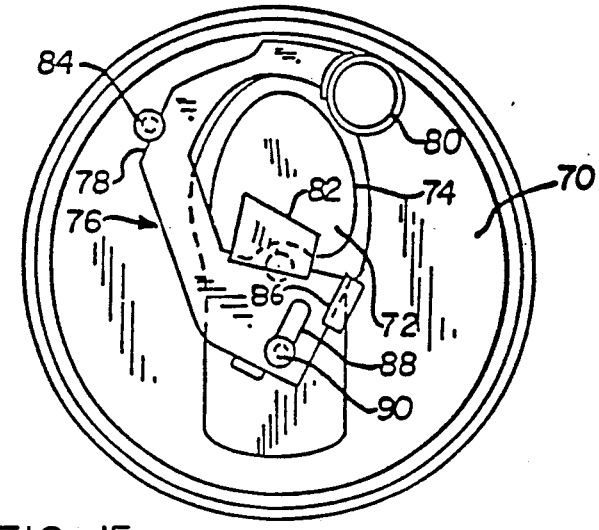
FIG. 15 is a bottom view of a closed lid having a straw delivery assembly.
Figure 16:
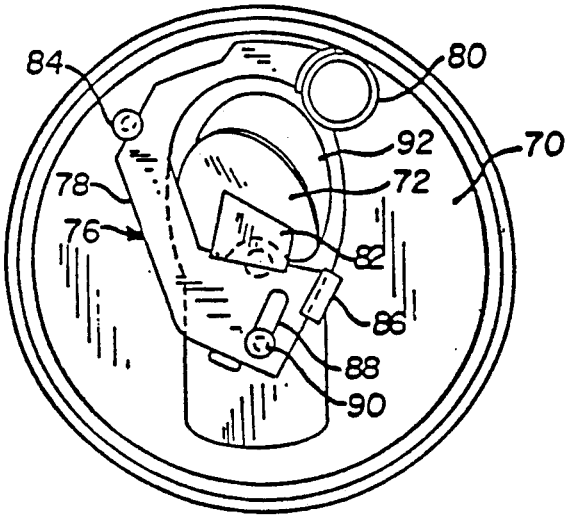
FIG. 16 is a bottom view of the lid of FIG. 15 open to a drinking position without pop-up straw.
Figure 17:
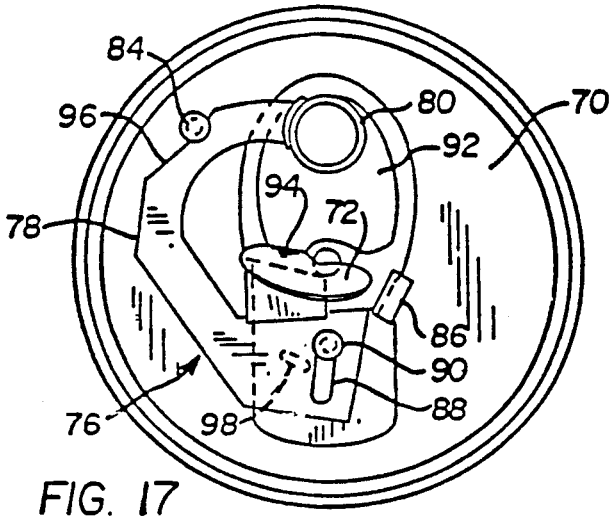
FIG. 17 is a bottom view of the lid of FIG. 15 open to a straw pop-up position.

FIGS. 15, 16 and 17 illustrate a different straw delivery mechanism than is described above. The mechanism of FIGS. 15, 16 and 17 employs both linear and rotary movement for positioning a straw at a container opening. These figures show the underside of lid 70. In FIG. 15, panel 72 is closed and score line 74 is not broken. A U-shaped or arc-shaped arm 78 is provided with a straw holding receptacle 80 at one end and a downwardly extending elbow 82 at the other end. Movement of the straw is restrained during shipment by means of guide or rivet 84 on one side of the arm and guide 86 on the other side of the arm. One end of arm 78 is provided with elongated slot 88 which is slideably captured by rivet 90.

FIG. 16 shows panel 72 bent downwardly to a first position to provide opening 92 for drinking. However, the bending of the underside of panel 72 at said first position is limited so that the underside of panel 72 is not yet in contact with elbow 82 and no movement has yet been imparted to straw delivery mechanism 76.

FIG. 17 shows panel 72 bent further to a second position whereat it is bent more than 90 degrees and is connected to lid 70 at hinge 94. In this position the underside of panel 72 has contacted elbow 82 and has forced arm 78 rearwardly in a linear direction along linear slot 88 while arm 78 remains within the confines determined by guide members 84 and 86. Finally, when mechanism 76 is moved linearly to an extend that it is fee of the restraint of guide member 86, as shown in FIG. 17, further movement under the influence of panel 72 causes rotary movement of arm 78 by movement of cammed edge 96 of arm 78 along guide 84 so that arm 78 rotates about rivet 90 to move straw holding receptacle 80 under opening 92. In this position, mechanism 76 is deprived of the stabilizing effect of guide 86. However, downwardly impressed dimple 98 in lid 70 pressing against arm 78 can be used to retain arm 78 in a stable condition for drinking.

The details of a preferred resilient pop-up straw are shown in FIG. 14. Straw 26 in FIG. 14 has a straight vertical top section 100 and three sequential bends 102, 104 and 106 below said top, each comprising a corrugated section of straw. Straight downwardly inclined sections 108 and 110 descend sequentially from bends 102 and 104, respectively. Bend 104 bears upon the inner wall of the cylindrical container at a first position therein and bend 106 bears upon the inner wall the cylindrical container at a second position therein, where the first and second positions are diametrically opposed from each other. Bend 106 leads to corrugated curved region 112 which follows the curved contour of the cylindrical container at the base thereof and bears upon a portion of the circumference of said base.

It will be appreciated that the coiling of the straw along the base of the container provides a base support for the straw so that no attachments in the cylindrical container are required to hold the straw, except at the holding mechanism at the lid. This arrangement prevents the straw from moving during shipment. The bottom coil and bends 102, 104 and 106 provide a compressive effect and promote a spring-like action when the straw is moved to the can opening, as described above.

I claim:

1. A straw for storage entirely within a cylindrical beverage container, said straw having a vertical top section and at least two bends located below said top section with each of said bends having a downwardly inclined section descending therefrom, sequential inclined section inclining downwardly in diametrically opposite directions so that said straw can bear upon the cylindrical wall of said container at diametrically opposite sides of the wall of said container.

2. The straw of claim 1 wherein said bends comprise corrugated straw sections.

3. A straw for storage entirely within a cylindrical beverage container, said straw having a vertical top section and at least one bend below said top section with an inclined section descending from each bend so that said straw can bear upon the cylindrical wall of said container, and the bottom section of said straw being curved so that said curved section can extend along the curved junction of the cylindrical wall and the bottom of said container.

4. The straw of claim 3 wherein each bend and said curved section comprise corrugated straw sections.

5. A straw for storage entirely within a cylindrical beverage container, said straw having a vertical top section and at least two bends located below said top section with each of said bends having a downwardly inclined section descending therefrom, the end of the first of said inclined sections adapted to bear upon the cylindrical wall of said container at a first position thereon and the end of the second of said sections adapted to bear on the cylindrical wall of said container at a second position thereon, said second position being diametrically opposed with respect to said first position, the bottom section of said straw being curved, said curved section adapted for bearing on the curved junction of the cylindrical wall and the bottom of said container.

6. The straw of claim 5 wherein each of said bends and said curved section comprise corrugated straw sections.

7. A straw for storage entirely within a cylindrical beverage container, said straw having a vertical straight top section and three bends below said top, a first straight downwardly inclined section descending from the first bend to a second bend, said second bend adapted to bear on the cylindrical wall of said container at a first position thereon, a second straight downwardly inclined section descending from said second bend to a third bend, said third bend adapted to bear on the cylindrical wall of said container at a second position thereon, said first and said second positions being at diametrically opposite sides of said cylindrical wall, respectively, said third bend leading to a curved bottom section of said straw, and said curved bottom section adapted for bearing on the curved junction of the cylindrical wall and the bottom of said container.

8. The straw of claim 7 wherein each of said bends and said curved bottom section comprise corrugated straw sections.

* * * * *